US005958870A

United States Patent [19]

Declercq et al.

[11] Patent Number: 5,958,870

[45] Date of Patent: Sep. 28, 1999

[54] BETAINE ESTER COMPOUNDS OF ACTIVE ALCOHOLS

[75] Inventors: Marc Johan Declercq, Strombeek-Bever; Hugo Jean-Marie Demeyere, Merchtem, both of Belgium; Arnaud Pierre Struillou, Nescastle upon Tyne, United Kingdom

[73] Assignee: The Procter & Gamble Company, Cincinnati, Ohio

[21] Appl. No.: 09/155,779

[22] PCT Filed: Mar. 27, 1997

[86] PCT No.: PCT/US97/04959

§ 371 Date: Oct. 1, 1998

§ 102(e) Date: Oct. 1, 1998

[87] PCT Pub. No.: WO97/36978

PCT Pub. Date: Oct. 9, 1997

[30] Foreign Application Priority Data

Apr. 1, 1996 [EP] European Pat. Off. ..... 96302291

[51] Int. Cl.[6] ..... C11D 1/46; C11D 1/62

[52] U.S. Cl. ..... 510/504; 510/102; 510/107

[58] Field of Search ..... 510/107, 423, 510/504, 518, 102

[56] References Cited

FOREIGN PATENT DOCUMENTS

| | | |
|---|---|---|
| 3527974 | 2/1987 | Germany . |
| 6-228873 | 8/1994 | Japan . |
| WO 93/25648 | 12/1993 | WIPO . |
| WO 95/08976 | 4/1995 | WIPO . |

*Primary Examiner*—Mark Kopec
*Assistant Examiner*—John R. Hardee
*Attorney, Agent, or Firm*—Richard S. Echler, Sr.; Kim William Zerby; Jacobus C. Rasser

[57] ABSTRACT

The present invention relates to a composition and process for preparing such a composition which provides stabilized betaine ester compounds of active alcohols in an acidic environment. In particular, it relates to an aqueous acidic composition comprising: a) a betaine ester of an active alcohol which, at a concentration of from 0.01% to 10% by weight in said composition, is predominantly in the form of micelles and/or is capable of being incorporated into micelles, b) a surfactant, said composition comprising an acidic material in sufficient amount to render the pH of the composition of less than 7.

14 Claims, No Drawings

BETAINE ESTER COMPOUNDS OF ACTIVE ALCOHOLS

FIELD OF THE INVENTION

The present invention relates to betaine ester compounds of active alcohols. More particularly, it relates to stabilized betaine ester compounds of active alcohols in an acidic environment such as in a fabric softener composition.

BACKGROUND OF THE INVENTION

Cleaning and laundry products are well known in the art. However, consumer acceptance of cleaning and laundry products is determined not only by the performance achieved with these products but also the aesthetics associated therewith. The perfume components are therefore an important aspect of the successful formulation of such commercial products.

Accordingly, formulations of compounds which provide a slow release of the perfume over a longer period of time than by the use of the perfume itself have been provided. Disclosure of such compounds may be found in WO 95/04809, WO 95/08976 and pending application EP 95303762.9. Pending application EP 95303762.9 describes betaine ester compounds of perfume alcohols which provide release of the perfume components over a long period of time.

Although betaine ester compounds are effective in the slow release of perfume, it has now been found that in an acidic environment such as in acidic product, the described compounds hydrolyse upon storage to release their perfume component, therefore reducing the amount of perfume alcohol released upon and after the washing or cleaning process. By acidic environment, it is meant a pH value of less than 7.0.

The formulator of a laundry and/or cleaning compositions is thus faced with the challenge of formulating a compound which is stable in an acidic environment but which still produces a slow release of the active alcohol (e.g perfume) upon and after the washing or cleaning process.

The Applicant has now found that the provision of betaine ester compounds of active alcohols in combination with a surfactant, wherein said betaine esters at a concentration of from 0.01% to 10% by weight are predominantly in the form of micelles, and/or are capable of being incorporated into micelles, overcomes the problem. Preferably, said betaine esters have at least one long alkyl chain.

Therefore, the present invention encompasses acidic compositions comprising betaine ester compounds of active alcohol components having a long alkyl chain, which at a concentration of from 0.01% to 10% by weight are predominantly in the form of micelles, and/or are capable of being incorporated into micelles, in combination with a surfactant. For optimum benefit of storage stability and slow release of the active alcohol upon and after the washing or cleaning process, a cationic surfactant is preferred.

Not to be bound by theory, it is believed that the use of betaine ester compounds with at least one long alkyl chain provide said betaine esters with a hydrophobic character which enable them to be rearranged in micelle form and/or to be incorporated into micelles, thereby protecting the ester bond from hydrolysis by the acidic environment.

For the purpose of the invention, the term "acidic aqueous composition" includes compositions having a pH value below or equal to 7.0, whereby the pH is measured at 20° C. in the neat liquid product.

By "slow release" is meant release of the active component (e.g perfume) over a longer period of time than by the use of the active (e.g perfume) itself.

Accordingly, the slow release concept and storage stability advantage of the invention may be applied to other active alcohol components such as a flavour alcohol ingredient, a pharmaceutical alcohol active or a biocontrol alcohol agent and any other active alcohol component where a slow release of said active component is necessary.

SUMMARY OF THE INVENTION

The present invention relates to an aqueous acidic composition comprising a) a betaine ester of an active alcohol which, at a concentration of from 0.01% to 10% by weight, is predominantly in the form of micelles, and/or is capable of being incorporated into micelles, and b) a surfactant, said composition comprising an acidic material in sufficient amount to render the pH of the composition of less than 7.

In a preferred embodiment of the invention, the betaine ester is a hydrophobic betaine ester of formula:

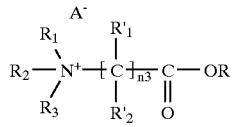

wherein each $R_1$, $R_2$, $R_3$ independently, is selected from hydrogen, alkyl group, aryl group,

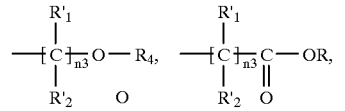

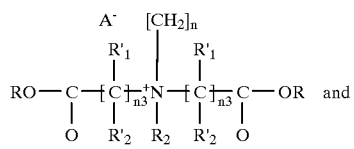

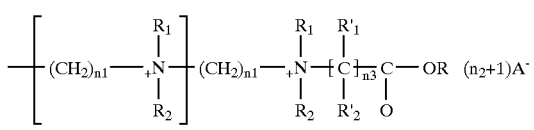

and with the proviso that where each R1, R2 and R3, independently, are only selected from hydrogen, aryl or alkyl groups, then at least one of R1, R2 or R3 is an alkyl or aryl group having at least 8 carbon atoms, wherein $R_4$ is an alkyl group having from 7 to 19 carbon atoms, wherein each $R'_1$, $R'_2$, independently, is selected from hydrogen, alkyl group, aryl group, —CH2—COOH, —CH2—COOR, —CH2—CH2—COOH and —CH2—CH2—COOR, wherein each n, $n_1$, independently, is an integer lying in the range from 1 to 20, and wherein n2 is an integer lying in the range of 0 to 20, wherein each $n_3$, independently, is an integer lying in the range from 1 to 3, and wherein each R, independently, is an organic chain of an active alcohol.

In another aspect of the invention a process for preparing said acidic composition is provided, whereby said process further improves the betaine ester protection from the acidic environment. A typical process for preparing a composition containing a surfactant comprises the following steps:

mixing the surfactant and optional components, if any, at a temperature above the melting point of the surfactant, preparing a waterseat, dispersing the mixture prepared above in the waterseat, and optionally, cooling the resulting dispersion.

Protection of the betaine ester occurs by incorporation of said betaine ester with the molten surfactant, or prior to dispersion of the molten surfactant in a waterseat, or with the surfactant dispersion while the dispersion is at a temperature above the Krafft point of the surfactant or combination of any of the above.

DETAILED DESCRIPTION OF THE INVENTION

Betaine Ester Compounds of Active Alcohols

An essential component of the invention is a betaine ester of an active alcohol, which, at a concentration of from 0.01% to 10% by weight in said composition, is predominantly in the form of micelles, and/or is capable of being incorporated into micelles, e.g a micelle can be composed of 100% betaine esters or mixed betaine esters/surfactants. Preferably, the betaine ester compounds of an active alcohol have the general formula below:

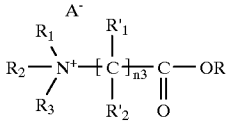

wherein each $R_1$, $R_2$, $R_3$ independently, is selected from hydrogen, alkyl group, aryl group,

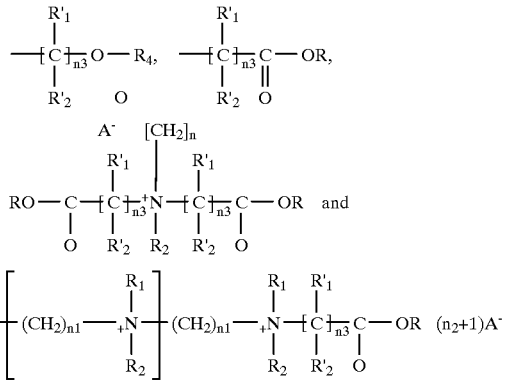

and with the proviso that where each R1, R2 and R3, independently, are only selected from hydrogen, aryl or alkyl groups, then at least one of R1, R2 or R3 is an alkyl or aryl group having at least 8 carbon atoms, wherein $R_4$ is an alkyl group having from 7 to 19 carbon atoms, wherein each $R'_1$, $R'_2$, independently, is selected from hydrogen, alkyl group, aryl group, —CH2—COOH, —CH2—COOR, —CH2—CH2—COOH and —CH2—CH2—COOR, wherein each n, $n_1$, independently, is an integer lying in the range from 1 to 20, and wherein n2 is an integer lying in the range of 0 to 20, wherein each $n_3$, independently, is an integer lying in the range from 1 to 3, and wherein each R, independently, is an organic chain of an active alcohol.

Preferably, each $n_2$, independently, is an integer lying in the range of 0 to 6.

Preferably, each n3, independently, is an integer of value 1 or 2, more preferably 1.

Preferably $R_1$, $R_2$, $R_3$ are each, independently selected from H, alkyl chain having from 1 to 20 carbon atoms, with the proviso that at least one of $R_1$, $R_2$ or $R_3$ is an alkyl group having at least 8 carbon atoms. Preferably $R'_1$, $R'_2$ are, each, independently selected from H, alkyl chain having 1 to 3 carbon atoms, phenyl.

For the above mentioned compounds, the R group, which is hydrophobic in nature, is the organic chain of an active alcohol, said active alcohol being selected from a flavour alcohol ingredient, a pharmaceutical alcohol active, a biocontrol alcohol agent, a perfume alcohol component and mixtures thereof. Flavour ingredients include spices, flavour enhancers that contribute to the overall flavour perception. Pharmaceutical actives include drugs. Biocontrol agents include biocides, antimicrobials, bactericides, fungicides, algaecides, mildewcides, disinfectants, antiseptics, insecticides, vermicides, plant growth hormones. Perfume alcohol components include components having odoriferous properties.

Preferably, for the above mentioned compounds, the R group is the organic chain of a perfume alcohol, said alcohol being selected from 2-phenoxyethanol, phenylethylalcohol, geraniol, citronellol, 3-methyl-5-phenyl-1-pentanol, 2,4-dimethyl-3-cyclohexene-1-methanol, linalool, tetrahydrolinalool, 1,2-dihydromyrcenol, hydroxycitronellal, farnesol, menthol, eugenol, vanilin, cis-3-hexenol, terpineol and mixtures thereof.

More preferred R groups, for the purpose of the invention, are selected from the organic chain of a perfume alcohol, said alcohol being selected from geraniol, citronellol, linalool, dihydromyrcenol and mixtures thereof.

Preferred compounds for the purpose of the invention are selected from geranyloxycarbonyl-N,N-dimethyl-N-dodecylmethanaminium bromide or chloride; citronellyloxycarbonyl-N,N-dimethyl-N-dodecylmethanaminium bromide or chloride; linalyloxycarbonyl-N,N-dimethyl-N-dodecylmethanaminium bromide or chloride; dihydromyrcenyloxycarbonyl-N,N-dimethyl-N-dodecylmethanaminium bromide or chloride.

Other preferred compounds are selected from N-dodecylglycine geranyl ester hydrobromide or hydrochloride; N-dodecylglycine citronellyl ester hydrobromide or hydrochloride; N-dodecylglycine linalyl ester hydrobromide or hydrochloride; N-dodecylglycine dihydromyrcenyl ester hydrobromide or hydrochloride.

Other preferred compounds are selected from N,N-dioctylglycine geranyl ester hydrobromide or hydrochloride; N,N-dioctylglycine citronellyl ester hydrobromide or hydrochloride; N,N-dioctylglycine linalyl ester hydrobromide or hydrochloride; N,N-dioctylglycine dihydromyrcenyl ester hydrobromide or hydrochloride.

Other preferred compounds are selected from N,N-didodecylglycine geranyl ester hydrobromide or hydrochloride; N,N-didodecylglycine citronellyl ester hydrobromide or hydrochloride, N,N-didodecylglycine linalyl ester hydrobromide or hydrochloride; N,N-didodecylglycine dihydromyrcenyl ester hydrobromide or hydrochloride.

Other preferred compounds are selected from N-(2-geranyloxy-2-oxoethyl)-N,N-dimethyl-2-geranyloxy-2-oxoethanaminium bromide or chloride; N-(2-citronellyloxy-2-oxoethyl)-N,N-dimethyl-2-citronellyloxy-2-oxoethanaminium bromide or chloride; N-(2-linalyloxy-2-oxoethyl)-N,N-dimethyl-2-linalyloxy-2-oxoethanaminium bromide or chloride; N-(2-dihydromyrcenyloxy-2-oxoethyl)-N,N-dimethyl-2-dihydromyrcenyloxy-2-oxoethanaminium bromide or chloride.

Other preferred compounds are selected from N-butyl-N-(2-geranyloxy-2-oxoethyl)glycine geranyl ester hydrobromide or hydrochloride; N-butyl-N-(2-citronellyloxy-2-oxoethyl)glycine citronellyl ester hydrobromide or hydrochloride; N-butyl-N-(2-linalyloxy-2-oxoethyl)glycine linalyl ester hydrobromide or hydrochloride; N-butyl-N-(2-dihydromyrcenyloxy-2-oxoethyl)glycine dihydromyrcenyl ester hydrobromide or hydrochloride.

Other preferred compounds are selected from N-dodecyl-N-(2-geranyloxy-2-oxoethyl)glycine geranyl ester hydrobromide or hydrochloride; N-dodecyl-N-(2-citronellyloxy-2-oxoethyl)glycine citronellyl ester hydrobromide or hydrochloride; N-dodecyl-N-(2-linalyloxy-2-oxoethyl) glycine linalyl ester hydrobromide or hydrochloride; N-dodecyl-N-(2-dihydromyrcenyloxy-2-oxoethyl)glycine dihydromyrcenyl ester hydrobromide or hydrochloride.

Other preferred compounds are selected from N,N-bis(2-geranyloxy-2-oxoethyl)glycine geranyl ester hydrobromide or hydrochloride; N,N-bis(2-citronellyloxy-2-oxoethyl) glycine citronellyl ester hydrobromide or hydrochloride; N,N-bis(2-linalyloxy-2-oxoethyl)glycine linalyl ester hydrobromide or hydrochloride; N,N-bis(2-dihydromyrcenyloxy-2-oxoethyl)glycine dihydromyrcenyl ester hydrobromide or hydrochloride.

Mixtures of any of the above components in the betaine ester used herein in the compositions of the invention may be used.

Preferably, levels of incorporation of said betaine ester compounds of active alcohols, into the acidic composition are from 0.01% to 8%, more preferably 0.05% to 5%, and most preferably from 0.1% to 2%, by weight of the total composition.

Surfactant

The other essential component of the invention is a surfactant. Such surfactant are selected from anionic, nonionic, cationic, amphoteric and zwiterrionic surfactants.

Anionic Surfactant

Essentially any anionic surfactants useful for detersive purposes can be included in the compositions. These can include salts (including, for example, sodium, potassium, ammonium, and substituted ammonium salts such as mono-, di- and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters)diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactants suitable for use herein include the linear and branched primary alkyl sulfates, alkyl ethoxysulfates, fatty oleyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl)glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_6$–$C_{18}$ alkyl sulfates which have been ethoxylated with from about 0.5 to about 20 moles of ethylene oxide per molecule. More preferably, the alkyl ethoxysulfate surfactant is a $C_6$–$C_{18}$ alkyl sulfate which has been ethoxylated with from about 0.5 to about 20, preferably from about 0.5 to about 5, moles of ethylene oxide per molecule.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic carboxylate surfactants suitable for use herein include the alkyl ethoxy carboxylates, the alkyl polyethoxy polycarboxylate surfactants and the soaps ('alkyl carboxyls'), especially certain secondary soaps as described herein. Preferred alkyl ethoxy carboxylates for use herein include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than about 20%, and the amount of material where x is greater than 7, is less than about 25%, the average x is from about 2 to 4 when the average R is $C_{13}$ or less, and the average x is from about 3 to 10 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{18}$ alkyl group.

Alkyl polyethoxy polycarboxylate surfactants suitable for use herein include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3CH(R^4)COOM$, wherein $R^3$ is $CH_3(CH_2)x$ and $R^4$ is $CH_3(CH_2)y$, wherein y can be O or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$—$R^6$—COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $$CH_3(CHR)_k—(CH_2)_m—(CHR)_n—CH(COOM)(CHR)_o—(CH2)_p—(CHR)_q—CH_3,$$

wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Other suitable anionic surfactants are the alkali metal sarcosinates of formula R—CON($R^1$)$CH_2$COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Nonionic Surfactant

Essentially any nonionic surfactants useful for detersive purposes can be included in the compositions. Exemplary, non-limiting classes of useful nonionic surfactants are listed below.

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, or a mixture thereof, preferable $C_1$–$C_{14}$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)t(glycosyl)_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3; t is from 0 to 10, preferably O, and X is from 1.3 to 8, preferably from 1.3 to 3, most preferably from 1.3 to 2.7. The glycosyl is preferably derived from glucose.

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Cationic Surfactant

Typical cationic surfactants for the purpose of the invention are those commonly mentioned as cationic fabric softener actives. Such cationic fabric softening components include the water-insoluble quaternary-ammonium fabric softening actives, the most commonly used having been di-long alkyl chain ammonium chloride.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl)dimethylammonium chloride (DSOEDMAC);
13) di(tallowoyloxyethyl)dimethylammonium chloride;
14) ditallow imidazolinium methylsulfate;
15) 1-(2-tallowylamidoethyl)-2-tallowyl imidazolinium methylsulfate.
16) ditallow imidazoline
17) ditallow imidazoline ester Also included within the scope of cationic fabric softening components are the more environmentally-friendly materials, and rapidly biodegradable quaternary ammonium compounds which have been presented as alternatives to the traditionally used di-long chain ammonium chlorides. Such quaternary ammonium compounds contain long chain alk(en)yl groups interrupted by functional groups such as carboxy groups. Said materials and fabric softening compositions containing them are disclosed in numerous publications such as EP-A-0,040,562, and EP-A-0,239,910.

The quaternary ammonium compounds and amine precursors herein have the formula (I) or (II), below:

(I)

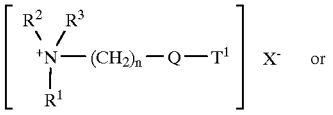

or (II)

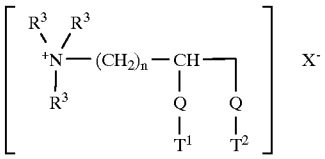

wherein Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion. Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl)ammonium chloride;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3-trimethylammoniopropane chloride;

and mixtures of any of the above materials.

Of these, compounds 1–7 are examples of compounds of Formula (I); compound 8 is a compound of Formula (II). Particularly preferred is N,N-di(tallowyl-oxy-ethyl)-N,N-dimethyl ammonium chloride, where the tallow chains are at least partially unsaturated. The level of unsaturation of the tallow chain can be measured by the Iodine Value (IV) of the corresponding fatty acid, which in the present case should preferably be in the range of from 5 to 100 with two categories of compounds being distinguished, having a IV below or above 25. Indeed, for compounds of Formula (I) made from tallow fatty acids having a IV of from 5 to 25, preferably 15 to 20, it has been found that a cis/trans isomer weight ratio greater than 30/70, preferably greater than 50/50 and more preferably greater than 70/30 provides optimal concentrability. For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the pH values.

Other cationic surfactants may also be used in addition to or in alternative to the above mentioned cationic surfactants having fabric softening properties. This include the monoalkyl ammonium halide such as trimethyl alkyl ammonium halide (R'—$N^+(Me)_3X^-$) such as C16 trimethyl ammonium bromide or C14 trimethyl ammonium bromide;

N-alkyl N,N-dimethyl-N(2-hydroxyethyl)ammonium ($R'—N^+(Me)_2CH_2CH_2OH\ X^-$) and mixtures thereof, and wherein R' is an alkyl chain having at least 8 carbons and $X^-$ is a conteranion as defined herein before.

Preferred among these surfactants are the cationic surfactants, most preferably the cationic surfactants mentioned above as having fabric softening properties.

Typical levels of said surfactants are from 0.1% to 80% by weight of the compositions.

Acidic Material

Acidic materials are essential to the stability of the composition of the invention. Acidity may be provided from the above mentioned betaine ester, especially with those selected from N-dodecylglycine geranyl ester hydrobromide or hydrochloride; N,N-dioctylglycine geranyl ester hydrobromide or hydrochloride; N,N-didodecylglycine geranyl ester hydrobromide or hydrochloride; N-butyl-N-(2-geranyloxy-2-oxoethyl)glycine geranyl ester hydrobromide or hydrochloride; N-dodecyl-N-(2-geranyloxy-2-oxoethyl) glycine geranyl ester hydrobromide or hydrochloride; N,N-bis(2-geranyloxy-2-oxoethyl)glycine geranyl ester hydrobromide or hydrochloride; and/or the cationic surfactants above mentioned themselves.

Conventional acidic materials may also be used. Suitable conventional acidic materials include the bronstead acids as well as the fatty acids. Examples of suitable acids include the inorganic mineral acids, carboxylic acids, in particular the low molecular weight ($C_1$–$C_5$) carboxylic acids, and alkyl sulfonic acids and mixtures thereof.

Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, formic and methylsulfonic acid.

The amount of acidic material should be such that the pH of the composition is less than 7, preferably from 2.0 to 5.5.

More preferably, where cationic surfactants are used, especially those mentioned as biodegradable fabric softening agents, optimum hydrolytic stability of these compositions will be obtained when the pH of the compositions, measured in the neat compositions at 20° C., is in the range of from 2.0 to 4.5.

Typically the amount of acid is from 1% to 30% by weight, preferably 2% to 30%, most preferably 3% to 15% by weight of the cationic surfactant.

Additional Ingredients

Additional perfume ingredients may be added to the acidic composition. When present, the composition will comprise up to 5% by weight, more preferably from 0.1% to 1.5% by weight of additional perfume.

Additional perfumes are those odorous materials that deposit on fabrics or surfaces during the laundry or cleaning process and are detectable by people with normal olfactory sensitivity. Many of the perfume ingredients along with their odour corrector and their physical and chemical properties are given in "Perfume and Flavor chemicals (aroma chemicals)", Stephen Arctender, Vols. I and 11, Aurthor, Montclair, H. J. and the Merck Index, 8th Edition, Merck & Co., Inc. Rahway, N.J. Perfume components and compositions can also be found in the art, e.g. U.S. Pat. Nos. 4,145,184, 4,152,272, 4,209,417 or 4,515,705.

A wide variety of chemicals are known for perfume use including materials such as aldehydes, ketones, esters and the like. More commonly, naturally occurring plant and animal oils and exudates comprising complex mixtures of various chemical components are known for use as perfume, and such materials can be used herein. Typical perfumes can comprise e.g. woody/earthy bases containing exotic materials such as sandalwood oil, civet and patchouli oil. The perfume also can be of a light floral fragrance e.g. rose or violet extract. Furthermore, the perfume can be formulated to provide desirable fruity odours e.g. lime, lemon or orange.

Particular examples of optional perfume ingredients and compositions are anetole, benzaldehyde, benzyl acetate, benzyl alcohol, benzyl formate, isobornyl acetate, camphene, cis-citral(neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, vertenex(para-tertiary-butyl cyclohexyl acetate), amyl cinnamic aldehyde, iso-amyl salicylate, beta-caryophyllene, cedrene, cinnamic alcohol, couramin, dimethyl benzyl carbinyl acetate, ethyl vanillin, eugenol, iso-eugenol, flor acetate, heliotrophine, 3-cis-hexenyl salicylate, hexyl salicylate, lilial(para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, veratraldehyde, alpha-cedrene, beta-cedrene, C15H24sesquiterpenes, benzophenone, benzyl salicylate, ethylene brassylate, galaxolide (1,3,4,6,7,8-hexahydro-4,6,6,7,8,8,-hexamethyl-cyclo-penta-gamma-2-benzopyran), hexyl cinnamic aldehyde, lyral (4(4-hydroxy-4-methyl pentyl)-3-cyclohexene-10-carboxaldehyde), methyl cedrylone, methyl dihydro jasmonate, methyl-beta-naphthyl ketone, musk ambrette, musk idanone, musk ketone, musk tibetine, musk xylol, aurantiol and phenylethyl phenyl acetate and mixtures thereof.

The compositions according to the present invention are suitable for use where acidic products and surfactants, preferably a cationic surfactant are present. Such acidic products include fabric softeners, hard surface cleaners, bathroom cleaners, shower gels, deodorants, bars, shampoos, conditioners.

Fabric Softener Compositions

When used as a fabric softener composition, the cationic surfactants which also act as fabric softener will preferably be present, depending on the composition execution, in amount of 1% to 8% by weight where the composition is in diluted form or in amount of 8% to 80%, more preferably 10% to 50%, most preferably 15% to 35% by weight where the composition is in concentrated form.

The fabric softener composition may also optionally comprise conventional softening ingredients such as non-ionic extenders, surfactants concentration aids, electrolyte concentration aids, stabilisers, such as well known antioxidants and reductive agents, Soil Release Polymers, emulsifiers, bacteriocides, colorants, perfumes, preservatives, optical brighteners, anti ionisation agents, antifoam agents and enzymes.

Process

Also provided herein by the present invention is a process for preparing a composition as described herein before, which comprises the steps of a) mixing the surfactant and optional components, if any, at a temperature above the melting point of the surfactant, b) preparing a waterseat, c) dispersing the mixture prepared in step a) in the waterseat, d) adding the betaine ester to d1) the mixture prepared under point a), or d2) the waterseat under point b), or d3) the surfactant dispersion under c), or d4) combination of any of the above, e) optionally, cooling the resulting dispersion.

Preferably the molten mixture of step a) will be dispersed in a waterseat of step b) above the Krafft temperature of the surfactant.

The waterseat may optionally contain additives such as polyethylene glycol or biocide. Acids may be added in step a) or directly to the waterseat of step b). Optional components such as dyes, perfumes if present will be added either before step e) once the resulting dispersion is made or after step e).

Preferably, during dispersion of the betaine ester in step d3), care should be taken that the temperature of the molten mixture is above the Krafft temperature of the surfactant. By Krafft temperature is meant the temperature at which the solubility of the surfactant becomes equal to the critical micelle concentration (CMC), the CMC being defined in M. J ROSEN, Surfactants and interfacial phenomena, 1988, p.215.

It is also preferred to apply sufficient shear to ensure adequate incorporation of the betaine ester into the micelles/vesicles. The amount of shear should be sufficient to properly disperse the surfactant. Proper dispersion can be verified by controlling the particle size of the resulting dispersion, by e.g microscopy or light scattering techniques. The particle size should preferably be below 50 $\mu$m.

With regard to the cooling step, it is preferred for optimal storage results to cool the resulting mixture below the Krafft temperature of the surfactant before the product is stored.

Not to be bound by theory, it is believed that such a process provides effective protection of the weak ester linkage of the betaine ester by shielding it from water; thus avoiding premature hydrolysis during storage. Preferably, for optimum protection provided by this process, the surfactant used is a cationic surfactant.

Perfume Synthesis Examples

1-Synthesis of N,N-dioctylglycine esters and N,N-didodecylglycine esters of unhindered alcohols by transesterification To a mixture of N,N-dioctylglycine methyl ester (47.02 g, 150 mmol, 1 eq) in toluene (250 ml) under argon was slowly added some sodium methoxide (1.01 g, 0.019 mol, 0.125 eq) and geraniol (27.3 ml, 158 mmol, 1.05 eq). The mixture was heated under vacuum (10 mm Hg) and the methanol produced by the transesterification reaction is distilled with toluene over one hour after which the reaction appeared completed by 1H NMR. Any remaining toluene is evaporated under vacuum. Diethyl ether was added (200 ml) and the mixture stored at 4° C. for one hour prior to filtration. The filtrate was then concentrated under vacuum yielding to the expected N,N-dioctylglycine geranyl ester as a light yellow oil (quantitative yield).

This type of synthesis can also be conveniently applied to the synthesis of N,N-dioctylglycine phenoxanyl ester; N,N-dioctylglycine cis-3-hexenyl ester as well as for N,N-didodecylglycine phenoxanyl ester, N,N-didodecylglycine cis-3-hexenyl ester and N,N-didodecylglycine geranyl ester with the exception that for the three last one N,N-dioctylglycine methyl ester is used in the synthesis instead of N,N-dioctylglycine methyl ester.

2-Synthesis of N,N-dioctylglycine esters and N,N-didodecylglycine esters of hindered alcohols (tertiary alcohols) using their chloroacetate or bromoacetate Dihydromyrcenyl bromoacetate (27.7 g, 100 mmol, 1 eq), in ethyl acetate (50 ml), was slowly added to dioctylamine (33 ml, 110 mmol, 1.1 eq) and sodium carbonate (21.2 g, 0.2 mol, 2 eq), in ethyl acetate (100 ml). The reaction mixture was stirred at ambient temperature for 72 hours after which the reaction seemed completed by 1H NMR. The sodium carbonate was filtered off, the filtrate was concentrated under vacuum and diethyl ether (200 ml) was added before storage of the solution at 4° C. for 12 hours. Then, the solution was filtered and removal of ether under vacuum yielded to the expected N,N-dioctylglycine dihydromyrcenyl ester as a yellow oil (38.05 g, 87% yield).

Linalyl chloroacetate (5.77 g, 25 mmol, 1 eq), in toluene (50 ml), was slowly added to didodecylamine (10 g, 28.3 mmol, 1.13 eq) and sodium carbonate (5.3 g, 0.05 mol, 2 eq), in toluene (50 ml). The reaction mixture was stirred at 60° C. for two weeks after which the reaction seemed completed by 1H NMR. The sodium carbonate was filtered off, the filtrate was concentrated under vacuum and diethyl ether (200 ml) was added before storage of the solution at 4° C. for 12 hours. Then, the solution was filtered and removal of ether under vacuum yielded to the expected N,N-didodecylglycine linalyl ester as a yellow oil.

This type of synthesis can also be conveniently applied to the synthesis of N,N-dioctylglycine esters and N,N-didodecylglycine esters of unhindered alcohols.

In all these experiments, the N,N-dioctylglycine esters hydrochloride or hydrobromide and the N,N-didodecylglycine esters hydrochloride or hydrobromide can be easily obtained by dissolving N,N-dioctylglycine esters or N,N-didodecylglycine esters in an organic solvant such as methanol, ethanol, isopropanol, petroleum ether, diethyl ether, toluene and adding at least a stoechiometric amount of mineral acid in water or in an organic solvant (such as HCl in isopropanol).

3-Synthesis of N-dodecyl-N-(2-geranyloxy-2-oxoethyl) glycine geranyl ester by transesterification (alcohol unhindered)

To a mixture of N-dodecyl-N-(2-methoxy-2-oxoethyl) glycine methyl ester (6.59 g, 20 mmol, 1 eq) in toluene (80 ml) under argon was slowly added some sodium methoxide (0.27 g, 0.005 mol, 2*0.125 eq) and geraniol (7.3 ml, 42 mmol, 2*1.05 eq). The mixture was heated under vacuum (10 mm Hg) and the methanol produced by the transesterification reaction was distilled with toluene over two hours after which the reaction appeared completed by 1H NMR. Any remaining toluene was evaporated under vacuum. Diethyl ether was added (200 ml) and the mixture stored at 4° C. for one hour prior to filtration. The filtrate was then concentrated under vacuum yielding to the expected N-dodecyl-N-(2-geranyloxy-2-oxoethyl)glycine geranyl ester as a light brown oil (quantitative yield).

This type of synthesis can also be conveniently applied to the synthesis of N-dodecyl-N-(2-phenoxanyloxy-2-oxoethyl)glycine phenoxanyl ester and N-dodecyl-N-(2-cis-3-hexenyloxy-2-oxoethyl)glycine cis-3-hexenyl ester as well as for the synthesis of N-butyl-N-(2-geranyloxy-2-oxoethyl)glycine geranyl ester, N-butyl-N-(2-phenoxanyloxy-2-oxoethyl)glycine phenoxanyl ester and N-butyl-N-(2-cis-3-hexenyloxy-2-oxoethyl)glycine cis-3-hexenyl ester with the exception that for the three last one N-butyl-N-(2-methoxy-2-oxoethyl)glycine methyl ester is used in the synthesis instead of N-dodecyl-N-(2-methoxy-2-oxoethyl)glycine methyl ester.

4-Synthesis of N-dodecyl-N-(2-linalyloxy-2-oxoethyl) glycine linalyl ester or N-dodecyl-N-(2-dihydromyrcenyloxy-2-oxoethyl)glycine dihydromyrcenyl ester (sterically hindered alcohol such as tertairy alcohols) using their chloroacetate or bromoacetate Dihydromyrcenyl bromoacetate (55.44 g, 200 mmol, 2 eq), in acetonitrile (75 ml), was slowly added to dodecylamine (24.2 ml, 100 mmol, 1 eq) and sodium carbonate (42.4 g, 0.4 mol, 4 eq), in acetonitrile (250 ml). The reaction mixture was stirred at ambient temperature for 48 hours after which the reaction seemed completed by 1H NMR. The sodium carbonate was filtered off, the filtrate was concentrated under vacuum and diethyl ether (200 ml) was added before storage of the solution at 4° C. for 12 hours. Then, the solution was filtered and removal of ether under vacuum yielded to the expected N-dodecyl-N-(2-dihydromyrcenyloxy-2-oxoethyl)glycine dihydromyrcenyl ester as a brown oil (56.2 g, 97.2% yield).

Linalyl chloroacetate (55.04 g, 200 mmol, 2 eq), in acetonitrile (75 ml), was slowly added to dodecylamine (24.2 ml, 100 mmol, 1 eq) and sodium carbonate (42.4 g, 0.4 mol, 4 eq), in acetonitrile (50 ml). The reaction mixture was stirred at 50° C. for two weeks after which the reaction seemed completed by 1H NMR. The sodium carbonate was filtered off, the filtrate was concentrated under vacuum and diethyl ether (200 ml) was added before storage of the solution at 4° C. for 12 hours. Then, the solution was filtered and removal of ether under vacuum yielded to the expected N-dodecyl-N-(2-linalyloxy-2-oxoethyl)glycine linalyl ester as a brown oil (48.6 g, 84.7% yield).

Synthesis of N-butyl-N-(2-linalyloxy-2-oxoethyl)glycine linalyl ester and N-butyl-N-(2-dihydromyrcenyloxy-2-oxoethyl)glycine dihydromyrcenyl ester is made as above with the exception that butylamine is used in the synthesis instead of dodecylamine.

This type of synthesis can also be conveniently applied to the chloroacetate or bromoacetate of unhindered alcohols such as geraniol, phenoxanol, cis-3-hexenol.

In all these experiments, the hydrochloride or hydrobromide salts can be obtained by dissolving for example N-butyl-N-(2-geranyloxy-2-oxoethyl)glycine geranyl ester in an organic solvant such as methanol, ethanol, isopropanol, petroleum ether, diethyl ether, toluene and adding at least a stoechiometric amount of mineral acid (HCl or HBr) in water or an organic solvant (such as HCl in isopropanol).

5-Synthesis of N,N-bis(2-geranyloxy-2-oxoethyl)glycine geranyl ester by transesterification (or any unhindered alcohol)

To a mixture of N,N-bis(2-methoxy-2-oxoethyl)glycine methyl ester (7.0 g, 30 mmol, 1 eq) in toluene (80 ml) under argon was slowly added some sodium methoxide (0.49 g, 0.009 mol, 3*0.10 eq) and geraniol (14.57 g, 95 mmol, 3*1.05 eq). The mixture was heated under vacuum (10 mm Hg) and the methanol produced by the transesterification reaction is distilled with toluene over two hours after which the reaction appeared completed by 1H NMR. Any remaining toluene is evaporated under vacuum. Diethyl ether was added (200 ml) and the mixture stored at 4° C. for one hour prior to filtration. The filtrate was then concentrated under vacuum yielding to the expected N,N-bis(2-geranyloxy-2-oxoethyl)glycine geranyl ester as a yellow oil (quantitative yield).

This type of synthesis can also be conveniently applied to the synthesis of N,N-bis(2-phenoxanyloxy-2-oxoethyl) glycine phenoxanyl ester and N,N-bis(2-cis-3-hexenyloxy-2-oxoethyl)glycine cis-3-hexenyl ester.

6-Synthesis of N,N-bis(2-linalyloxy-2-oxoethyl)glycine linalyl ester or N,N-bis(2-dihydromyrcenyloxy-2-oxoethyl) glycine dihydromyrcenyl ester (sterically hindered alcohols such as tertairy alcohols) using their chloroacetate or bromoacetate Dihydromyrcenyl bromoacetate (83.16 g, 300 mmol, 3 eq), in acetonitrile (100 ml), was slowly added to ammonia (50 ml of 2N solution in 2-propanol, 100 mmol, 1 eq) and sodium carbonate (63.6 g, 0.6 mol, 6 eq), in acetonitrile (350 ml). The reaction mixture was sealed and stirred at ambient temperature for 48 hours after which the reaction seemed completed by 1H NMR. The sodium carbonate was filtered off, the filtrate was concentrated under vacuum and diethyl ether (200 ml) was added before storage of the solution at 4° C. for 12 hours. Then, the solution was filtered and removal of ether under vacuum yielded to the expected N,N-bis(2-dihydromyrcenyloxy-2-oxoethyl)glycine dihydromyrcenyl ester as a brown oil.

Linalyl chloroacetate (82.56 g, 300 mmol, 3 eq), in acetonitrile (100 ml), was slowly added to ammonia (50 ml of 2N solution in 2-propanol, 100 mmol, 1 eq) and sodium carbonate (63.6 g, 0.6 mol, 6 eq), in acetonitrile (350 ml). The reaction mixture was stirred at 50° C. for two weeks after which the reaction seemed completed by 1H NMR. The sodium carbonate was filtered off, the filtrate was concentrated under vacuum and diethyl ether (200 ml) was added before storage of the solution at 4° C. for 12 hours. Then, the solution was filtered and removal of ether under vacuum yielded to the expected N,N-bis(2-linalyloxy-2-oxoethyl) glycine linalyl ester as a brown oil.

This type of synthesis can also be conveniently applied to the synthesis of chloroacetate or bromoacetate of unhindered alcohols such as geraniol, phenoxanol, cis-3-hexenol.

In all these experiments, the hydrochloride or hydrobromide salts can be obtained by dissolving for example N,N-bis(2-linalyloxy-2-oxoethyl)glycine linalyl ester in an organic solvant such as methanol, ethanol, isopropanol, petroleum ether, diethyl ether, toluene and adding at least a stoechiometric amount of mineral acid (HCl or HBr) in water or an organic solvant (such as HCl in isopropanol).

The invention is illustrated in the following non-limiting examples, in which all percentages are on a weight basis unless otherwise stated.

In the examples, the abbreviated component identifications have the following meaning:

| | |
|---|---|
| DEQA | Di-(tallowoyl-oxy-ethyl) dimethyl ammonium chloride |
| Fatty acid | Stearic acid of IV = 1 |
| Electrolyte | Calcium chloride |
| DGGE | N-dodecylglycine geranyl ester hydrochloride |
| PEG | Polyethylene Glycol 4000 |
| CTAB | C16 trimethyl ammonium bromide |
| Cetrimide | C14 trimethyl ammonium bromide |
| Dobanol ® 23-3 | C12–C13 ethoxylated alcohol with an average degree of ethoxylation of 3, available from Shell |
| Lutensol ® AO 30 | C13–15 alcohol ethoxylated with an average degree of ethoxylation of 30, available from BASF |
| Dobanol ® 91-10 | C19–C21 ethoxylated alcohol with an average degree of ethoxylation of 10, available from Shell |
| Dobanol ® 23-6.5 | C12–C13 ethoxylated alcohol with an average degree of ethoxylation of 6.5, available from Shell |
| Alkyl sulphate | Based on Isalchem 123 ® alcohol, C12–13 alcohol, 94% branched, available from Enichem |

EXAMPLE 1

The following fabric softening compositions according to the present invention were prepared:

| Component | A | B | C | D | E |
|---|---|---|---|---|---|
| DEQA | 2.6 | 2.9 | 18.0 | 19.0 | 19.0 |
| Fatty acid | 0.3 | — | 1.0 | — | — |
| Hydrochloride acid | 0.02 | 0.02 | 0.02 | 0.02 | 0.02 |
| PEG | — | — | 0.6 | 0.6 | 0.6 |
| Perfume | 1.0 | 1.0 | 1.0 | 1.0 | 1.0 |
| Silicone antifoam | 0.01 | 0.01 | 0.01 | 0.01 | 0.01 |
| DGGE | 1 | 0.5 | 1 | 0.5 | 1 |
| Electrolyte | — | — | 600 ppm | 600 ppm | 1200 ppm |
| Dye | 10 ppm | 10 ppm | 50 ppm | 50 ppm | 50 ppm |
| Water and minors to balance to 100 | | | | | |

EXAMPLE 2

The following hard surface cleaner compositions according to the present invention were prepared by mixing the listed ingredients

| | F | G | H | I |
|---|---|---|---|---|
| CTAB | 3.2 | — | — | — |
| Cetrimide | — | 4.2 | — | — |
| C8–10 dimethyl amine oxide | — | — | — | 4.40 |
| Lutensol ® AO 30 | — | — | 0.75 | 3.0 |
| Dobanol ® 91-10 | — | — | 2.60 | — |
| Dobanol ® 23-6.5 | — | — | 0.90 | — |
| Dobanol ® 23-3 | — | — | 1.75 | — |
| Maleic acid | 8.0 | 8.6 | — | — |
| Citric acid | — | — | — | 5.50 |
| Alkyl sulphate | — | — | — | 4.0 |
| Ammonia (as $NH_4OH$) | — | — | — | 0.40 |
| Propane diol | — | — | — | 1.30 |
| $H_2O_2$ | — | — | 7.0 | — |
| $H_2SO_4$ up to pH | — | — | 4.0 | — |
| DGGE | 1.0 | 0.5 | 1.0 | 0.6 |
| water and miscellaneous to balance | | | | |
| pH as is | 1.0 | 0.9 | 4.0 | 3.2 |

We claim:

1. An aqueous composition comprising:

a) from 0.01% to 10% by weight of, a betaine ester provided said betaine ester is predominantly in the form of a micelle or which is capable of forming a micelle, said betaine ester having the formula:

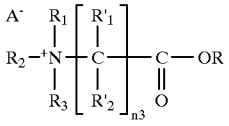

wherein each $R_1$, $R_2$, and $R_3$ is independently selected from the group consisting of:

i) hydrogen;

ii) $C_1$–$C_{20}$ alkyl provided at least one other $R_1$, $R_2$, or $R_3$ unit comprises a $C_8$–$C_{20}$ alkyl unit;

iii) aryl;

iv) an ester comprising unit having the formula:

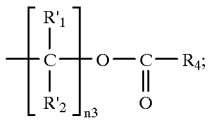

v) an ester comprising unit having the formula:

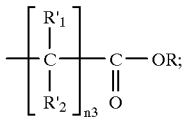

vi) an amino ester comprising unit having the formula:

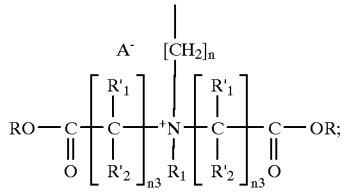

and vii) poly amino ester units having the formula:

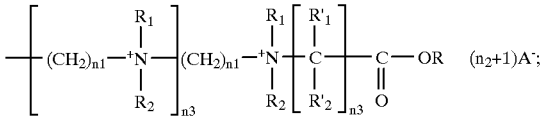

wherein $R_4$ is $C_7$–$C_{19}$ alkyl; $R'_1$ and $R'_2$ are each independently selected from the group consisting of hydrogen, $C_1$–$C_3$ alkyl, phenyl, —$CH_2CO_2H$, —$CH_2CO_2R$, —$CH_2CH_2CO_2H$, —$CH_2CH_2CO_2R$, and mixtures thereof; n and $n_1$ are each from 1 to 20; $n_2$ is from 0 to 20; each $n_3$ is independently from 1 to 3; each —OR is derived from a fragrance or perfume alcohol selected from the group consisting of 2-phenoxyethanol, phenylethyl alcohol, geraniol, citronellol, 3-methyl-5-phenyl-1-pentanol, 2,4-dimethyl-3-cyclohexene-1-methanol, linalool, tetrahydrolinalool, 2-dihydromyrcenol, hydroxycitronellal, farnesol, menthol, eugenol, vanillin, cis-3-hexenol, terpineol, and mixtures thereof; A is a water soluble anion;

b) from 0.% to 80% by weight, of a surfactant;

c) the balance carriers and other adjunct ingredients;

provided said betaine esters comprises at least one of said amino ester units from (vii) or one of said polyamino ester units from (vii) and further said composition has a pH of less than 7.

2. A composition according to claim 1 wherein $R_1$ and $R_2$ are each $C_1$–$C_{20}$ alkyl and $R_3$ is $C_8$–$C_{20}$ alkyl.

3. A composition according to claim 2 wherein $R_1$ and $R_2$ are each methyl and $R_3$ is $C_8$–$C_{20}$ alkyl.

4. A composition according to claim 3 wherein $R_3$ is dodecyl.

5. A composition according to claim 1 wherein $R_1$ and $R_2$ are each $C_8$–$C_{20}$ alkyl and $R_3$ is $C_1$–$C_{20}$ alkyl.

6. A composition according to claim 2 wherein $R_1$ and $R_2$ are each $C_8$–$C_{20}$ alkyl and $R_3$ is methyl.

7. A composition according to claim 3 wherein $R_1$ and $R_2$ each octyl or dodecyl.

8. An aqueous composition comprising:

a) from 0.01% to 10% by weight of, a betaine ester provided said betaine ester is predominantly in the form of a micelle or which is capable of forming a micelle, said betaine ester having the formula:

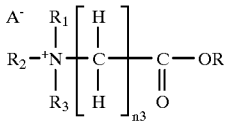

wherein each $R_1$, $R_2$, and $R_3$ is independently selected from the group consisting of:

i) hydrogen;

ii) $C_1$–$C_{20}$ alkyl provided at least one other $R_1$, $R_2$, or $R_3$ unit comprises a $C_8$–$C_{20}$ alkyl unit;

iii) and mixtures thereof;

—OR is derived from a fragrance or perfume alcohol selected from the group consisting of 2-phenoxyethanol, phenylethyl alcohol, geraniol, citronellol, 3-methyl-5-phenyl-1-pentanol, 2,4-dimethyl-3-cyclohexene-1-methanol, linalool, tetrahydrolinalool, 1,2-dihydromyrcenol, hydroxycitronellal, farnesol, menthol, eugenol, vanillin, cis-3-hexenol, terpineol, and mixtures thereof; A is a water soluble anion; $n_3$ is from 1 to 3;

b) from 0.1% to 80% by weight, of a quaternary ammonium compound having the formula:

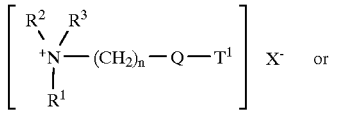

or

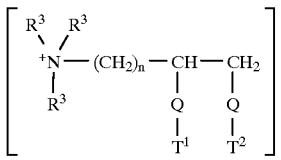

wherein Q is selected from —O—C(O)—, —C(O)—O—, —O—C(O)—O—, —NHR$^4$—C(O)—, —C(O)—NHR$^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^3$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

m and n are integers from 1 to 4; and X is a water soluble anion; and c) the balance carriers and other adjunct ingredients; provided said betaine esters comprises at least one of said amino ester units from (vii) or one of said polyamino ester units form (vii) and further said.

9. A composition according to claim 8 wherein the index $n_3$ is equal to 1.

10. A composition according to claim 8 wherein said quaternary ammonium compound is selected from the group consisting of N,N-di(tallowyl-oxy-ethyl)-N,N-dimethyl ammonium chloride; N,N-di(canolyl-oxy-ethyl)-N,N-dimethyl ammonium chloride; N,N-di(tallowyl-oxy-ethyl)-N-methyl, N-(2-hydroxyethyl)ammonium methyl sulfate; N,N-di(canolyl-oxy-ethyl)-N-methyl, N-(2-hydroxyethyl) ammonium methyl sulfate; and mixtures thereof.

11. A process for preparing a composition comprising:

a) from 0.01% to 10% by weight of, a betaine ester provided said betaine ester is predominantly in the form of a micelle or which is capable of forming a micelle, said betaine ester having the formula:

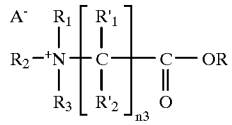

wherein each $R_1$, $R_2$, and $R_3$ is independently selected from the group consisting of:

i) hydrogen;

ii) $C_1$–$C_{20}$ alkyl provided at least one other $R_1$, $R_2$, or $R_3$ unit comprises a $C_8$–$C_{20}$ alkyl unit;

iii) aryl;

iv) an ester comprising unit having the formula:

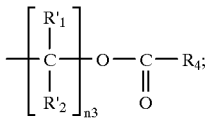

v) an ester comprising unit having the formula:

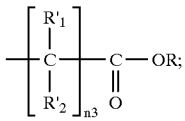

vi) an amino ester comprising unit having the formula:

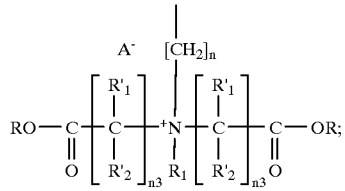

and vii) poly amino ester units having the formula:

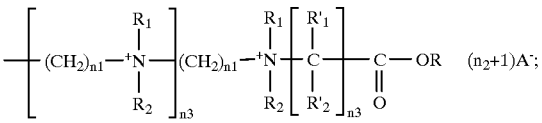

wherein $R_4$ is $C_7$–$C_{19}$ alkyl; $R'_1$ and $R'_2$ are each independently selected from the group consisting of hydrogen, $C_1$–$C_3$ alkyl, phenyl, —$CH_2CO_2H$, —$CH_2CO_2R$, —$CH_2CH_2CO_2H$, —$CH_2CH_2CO_2R$, and mixtures thereof; n and $n_1$ are each from 1 to 20; $n_2$ is from 0 to 20; each $n_3$ is independently from 1 to 3; each —OR is derived from a fragrance or perfume alcohol selected from the group consisting of 2-phenoxyethanol, phenylethyl alcohol, geraniol, citronellol, 3-methyl-5-phenyl-1-pentanol, 2,4-dimethyl-3-cyclohexene-1-methanol, linalool, tetrahydrolinalool, 1 2-dihydromyrcenol, hydroxycitronellal, farnesol, menthol, eugenol, vanillin, cis-3-hexenol, terpineol, and mixtures thereof; A is a water soluble anion;

b) from 0.1% to 80% by weight, of a surfactant;

c) the balance carriers and other adjunct ingredients;

provided said betaine esters comprises at least one of said amino ester units from (vii) or one of said polyamino ester units from (vii) and further said composition has a pH of less than 7; said process comprising the steps of:

a) mixing said surfactant, and said other adjunct ingredients at a temperature above the melting point of said surfactant to form an admixture;

b) preparing a waterseat;

c) dispersing said admixture in said waterseat to form a surfactant dispersion;

d) adding to any of the following:

i) said admixture formed in step (a); or ii) said waterseat prepared in step (b); or iii) said surfactant dispersion formed in step (c); or iv) combinations thereof;

e) forming a betaine ester micellular composition or a composition wherein said betaine esters are capable of forming a micellular phase; and f) optionally, cooling said capable of forming a micellular phase composition below a temperature which forms said micellular composition.

12. A method according to claim 11 wherein said temperature of step (a) is the Krafft temperature of said surfactant.

13. A method according to claim 11 wherein said temperature of step (f) is the Krafft temperature of said surfactant.

14. A method according to claim 11 wherein said composition is adjusted to a pH of less than 7 during said step (a) or (b).

* * * * *